US006705602B1

(12) United States Patent
Griffith, Sr.

(10) Patent No.: US 6,705,602 B1
(45) Date of Patent: Mar. 16, 2004

(54) VISE AFFORDING MULTIPLE SET-UP OPERATIONS

(76) Inventor: John W. Griffith, Sr., P.O. Box 66, New Egypt, NJ (US) 08533

( * ) Notice: Subject to any disclaimer, the term of this patent is extended or adjusted under 35 U.S.C. 154(b) by 0 days.

(21) Appl. No.: 10/253,938

(22) Filed: Sep. 25, 2002

(51) Int. Cl.[7] ..... B25B 1/24; B25B 5/16

(52) U.S. Cl. ..... 269/282; 269/266; 269/271

(58) Field of Search ..... 269/282, 261, 269/262, 279, 280, 281, 283, 284; 35/536, 537

(56) References Cited

U.S. PATENT DOCUMENTS 3,463,478 A * 8/1969 Hennessey ..... 269/271
4,861,010 A * 8/1989 Neil ..... 269/282
6,170,813 B1 * 1/2001 Bowers ..... 269/282
6,196,536 B1 * 3/2001 Hintze ..... 269/282
6,345,816 B1 * 2/2002 Fitzpatrick ..... 269/266
6,427,995 B1 * 8/2002 Steinwall ..... 269/283
6,601,839 B1 * 8/2003 Collins ..... 269/282

* cited by examiner

*Primary Examiner*—Joseph J. Hail, III
*Assistant Examiner*—Daniel Shanley
(74) *Attorney, Agent, or Firm*—Charles I. Brodsky

(57) ABSTRACT

A reversible jaw for a table vise including plurality of rows of apertures and cut-outs, all of predetermined size and location to allow manual and computerized machine operations to follow easily and precisely with reduced set-up procedure.

14 Claims, 5 Drawing Sheets

VISE AFFORDING MULTIPLE SET-UP OPERATIONS

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to manual and computerized machine operations utilizing vises in cutting, planing and drilling, for example, and to an improvement in construction to allow their jaws to be removed, modified, replaced, and reversed in alignment, in enhancing the various machine operations required.

2. Description of the Related Art

As is well known and understood, one requirement of a vise—especially when secured to a table or workbench—is that it be strong, firmly mounted, and accurate in the meeting of the jaws. For multiple duty needs, moreover, vises affording a variety of holding surfaces and positions lend themselves best for use. When employed in manufacturing operations, furthermore, the vise must be very accurate, regardless of the size of the piece being machined and regardless of its shape. Experience has shown that those vises presently available leave much to be desired as far as ease and reliability of set up operations are concerned.

SUMMARY OF THE INVENTION

As will become clear from the following description, the present invention proceeds from the development of a reversible jaw for a vise employing various plates, stop bars, location pins, parallels, depth gauges, pressure blocks and other accessories which can be easily coupled with the reversible jaw through the use of quick release screws. Rather than employing the commonly found flat machine jaws of these types of vises, a removable, reversible jaw is utilized which provides versatility of positioning for a variety of uses.

In accordance with the invention, such removable, reversible jaw includes a plurality of horizontally aligned rows of apertures through the jaw vertically displaced one row from another by predetermined amounts, and with the apertures of each row predeterminedly spaced one aperture from another and from the opposing side edges of the jaw. A first plurality of cut-outs of predetermined width with predetermined spacing between adjacent cut-outs is used, measured with respect to the side edges. With the first plurality of cut-outs extending downwardly a predetermined amount from the top edge of the jaw and extending rearwardly a predetermined amount from a front edge thereof, the basic construction of the removable jaw is completed. Such construction can be enhanced, however, by the inclusion of a second plurality of cut-outs of predetermined width and predetermined spacing between adjacent cut-outs, measured with respect to the side edges as well, with the second plurality of cut-outs extending downwardly a predetermined amount from the top edge of the jaw and extending forwardly a predetermined amount from a rear edge thereof. In a preferred embodiment of the invention, the cut-outs of each plurality are of equal side-to-side width, and are equally spaced one from another, as well as being of equal depth front-to-back. To further extend the usefulness of the removable, reversible jaw, the cut-outs of the first plurality are offset with respect to the cut-outs of the second plurality by one half the width of the cut-outs. To provide a series of steps upon which a. workpiece may rest, the front-to-back depth of the bottom surface of the reversible jaw is greater than the front-to-back depth of its top surface.

As will also become clear from the following description, the apertures of the plurality of rows are sized to accept various pins used to hold the parts to be machined at precise locations, and to facilitate the location of the jaws with respect to the movable bed of the vise itself. The number of apertures, their horizontal spacings, their vertical spacings, and their positionings will be seen to allow various numbers of accessories to be secured to the jaws in setting up a variety of machine operations, all with a very high degree of precision. By selecting predetermined dimensions for the apertures and their locations, for the cut-outs and their locations, and for the supports for the pieces being worked upon, a machinist just has to count-positions in order to set up the precise point where the operation is to start.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
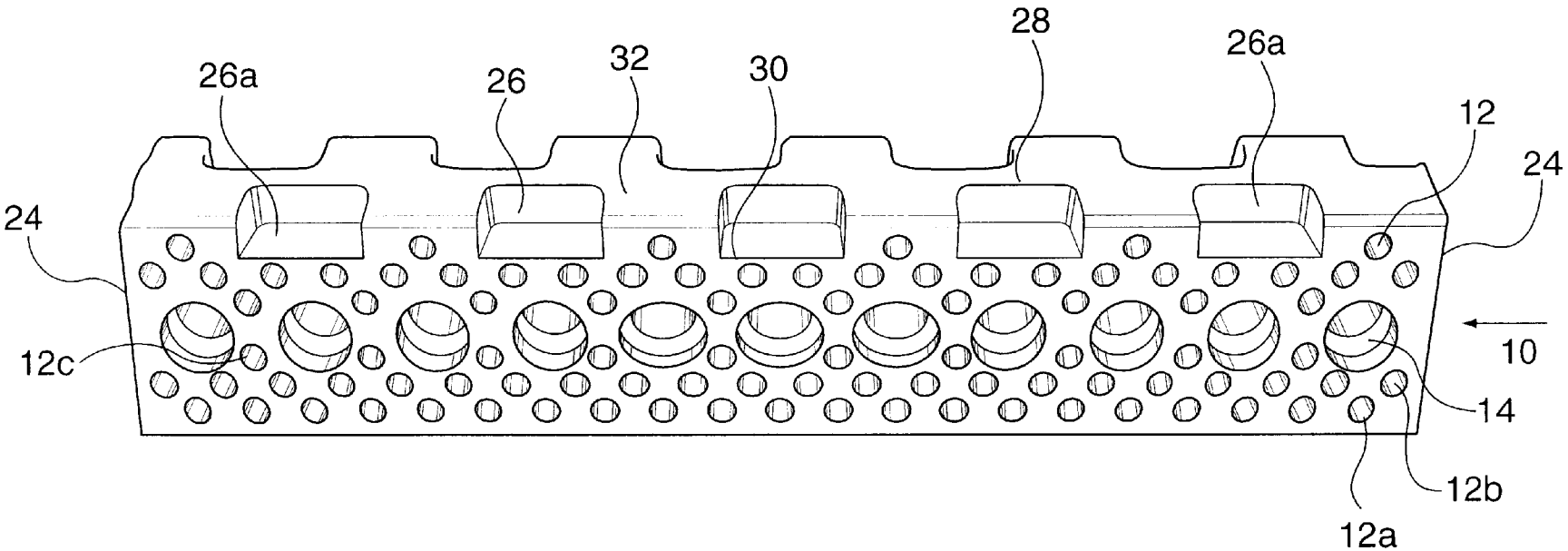
FIGS. 1 and 2 are front and rear perspective view, respectively, of a removable, reversible table or workbench vise jaw according to the present invention.

Referring to the Drawings, the removable, reversible jaw of the invention is shown at 10 as having a plurality of horizontally aligned rows of apertures 12 (6, in FIGS. 1 and 2), vertically displaced one from another by predetermined distances. The jaw 10, in use, is fitted onto the locator pins 16 of the table vise 18 of FIG. 3 through the apertures of a further horizontally aligned, parallel row 14, and then secured in position by means of bolts 18 inserted through the row 14 apertures as well. The jaws so secured are then adjusted towards, and away from, one another through movement of the bed 22 in conventional fashion.

Figure 2:
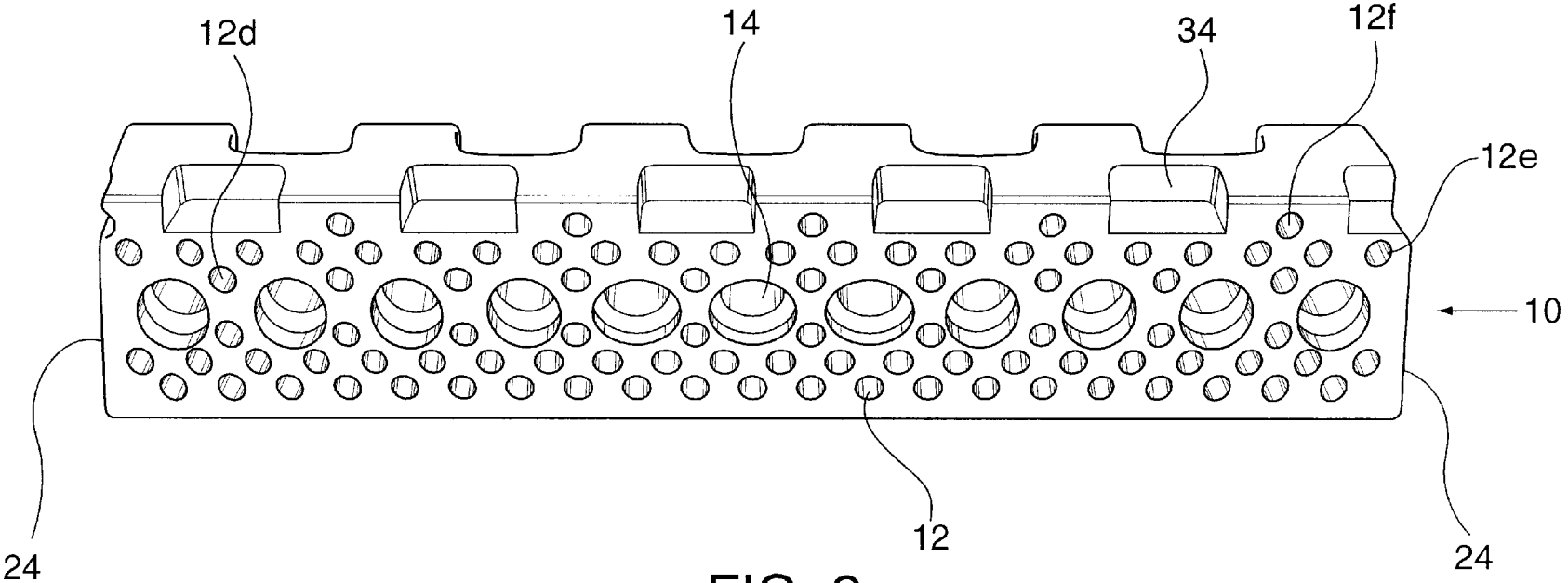
Figure 3:
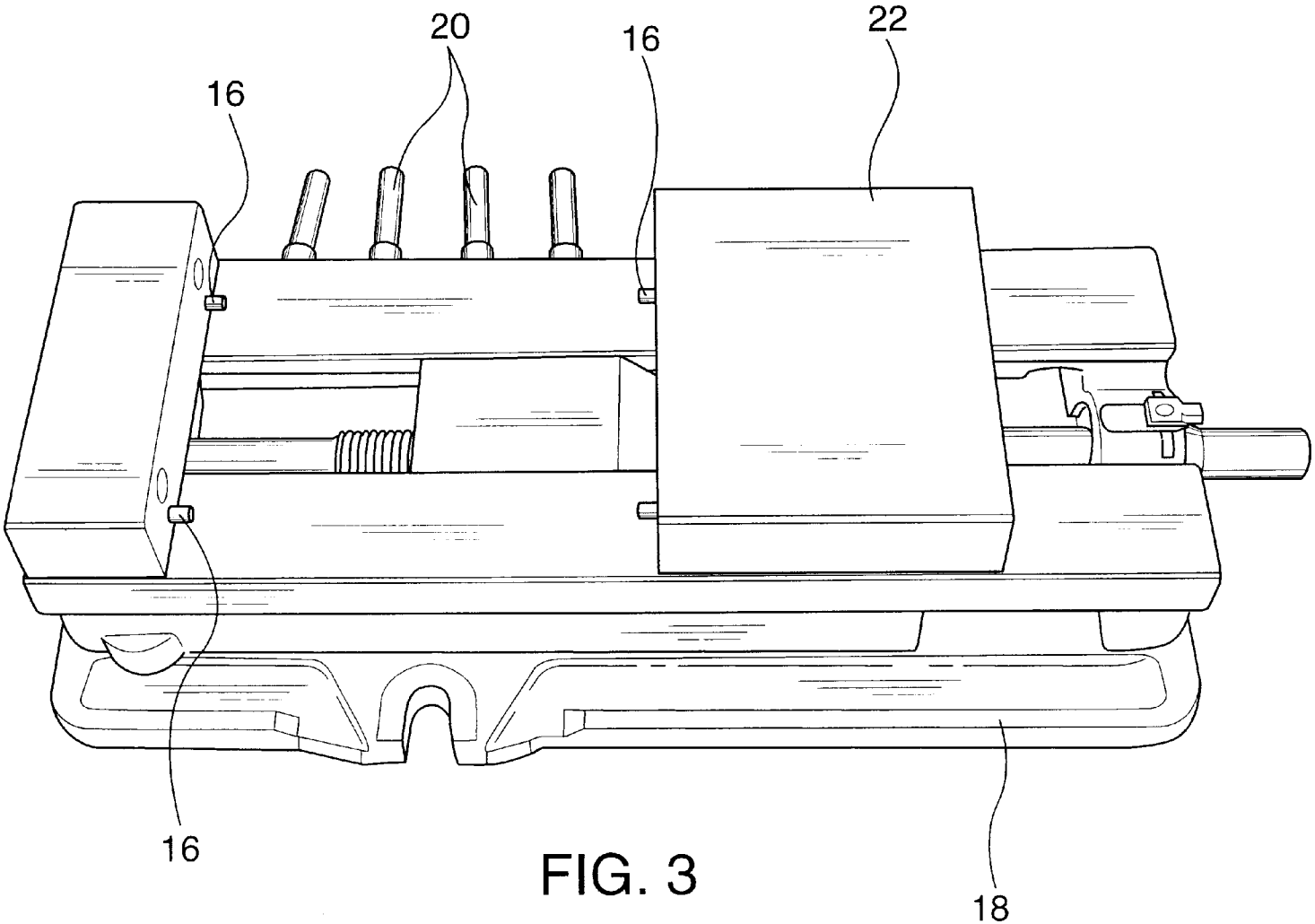
FIGS. 3–5 are pictorial views helpful in an understanding of the benefits available with the jaws of the invention.

As shown in FIGS. 1 and 2, the apertures of each row are predeterminedly spaced from one another, and from the opposing side edges 24 of the jaw 10, and with the apertures of each row being of identical size. In a preferred embodiment of the invention, the apertures of the row 14 are of larger diameter than the apertures of the rows 12, to receive the locator pins 16 and larger securing bolts 20. In such embodiment, the smaller apertures of rows 12*a*, 12*b* and 12*c* are spaced ½ inches apart, while those of rows 12*d* and 12*e*, and of row 12*f* are spaced apart 1 and 2 inches, respectively; the larger apertures of row 14, on the other hand, are spaced 1 inch apart. The vertical spacing in such embodiment between the rows 12*a*, 12*b*, and 12*c*, and between the rows 12*d*, 12*e* and 12*f* is ¼ inch, while the vertical spacing between the apertures of the rows 12*d* and 12*e* is ½ inch. In this embodiment, the apertures of the rows 12 are of a diameter to receive various pins (as described below), and may be of ¼ inch diameter; the larger apertures of the row 14 may be of ½ inch diameter.

The removable, reversible jaws also include a first plurality of cut-outs 26 of predetermined side-to-side width with predetermined spacing between adjacent cut-outs, measured with respect to the side edges 24. As shown, the cut-outs 26 extend downwardly a predetermined amount from a top edge 28 of the jaw 10, and extend rearwardly a predetermined amount from a front edge 30. In this preferred embodiment, the width of the cut-outs 26 is selected as 1 inch, and the spacing between adjacent cut-outs is of 1 inch as well. Each of the cut-outs 26*a* are spaced 1 inch from the side edges 24. The side edges 24 and the bottom surface of the removable, reversible jaw 10 are machined flat.

The top surface 32 of the jaw 10 extends to a point short of the front edge 30 by a predetermined amount—for example ⅛ inch—to form a step upon which a workpiece to be machined will be set to rest, according to the invention.

In a second embodiment of the invention, the removable, reversible jaw 10 also includes a second plurality of cut-outs 34 of predetermined width and predetermined spacing between adjacent cut-outs, also measured with respect to the side edges 24. As with the cut-outs 26, the second plurality of cut-outs 34 extend downwardly a predetermined amount from the top edge 28. In a manner similar to the cut-outs 26, the cut-outs 34 extend downwardly to a point which falls short of the rearedge 36 by a predetermined amount in forming a second step for clearance for machining purposes. In this second embodiment, as well as with the first embodiment, a step of 5/16 inch may be provided, along with cut-out width and spacing the same as with the cut-outs 26—namely, 1 inch. The cut-outs 34*a* in this embodiment, however, are spaced ½ inch from the side edges 24 so that the cut-outs 26 are offset with respect to the cut-outs 34 by ½ the width of the cut-outs shown. The top surface 32 of the jaw 10 thus extends to points short of the front and rear edges 30, 36, respectively.

As will be appreciated, the jaws 10 of FIG. 1 and 2 can be placed on the two sets of locator pins 16 of the vise 18 with either the front surfaces of the two jaws facing one another, or with the rear surfaces facing one another, allowing the bed 22 to be linearly moved to support the piece to be worked upon and to clamp it in position. Once the jaws are so locked, appositive "zero" is established, and a workpiece can be positioned to be machined at the desired location, simply by counting the number of spacings between the various apertures and cut-outs.

Many different manners of set-up can be had by establishing this positive "zero" location and the predetermined spacing between the various apertures of the pluralities of rows set out. For example, rather than having a pair of jaws in alignment opposite to one another, one of the two jaws employed can be offset with respect to the other simply by releasing the bolts 20 and moving them to different pairs of apertures in the row 14, going left-to-right, or right-to-left. Workpieces to be machined can be placed against pins, or between pins, placed within the various apertures of the rows 12, at different vertical elevations. For support of a workpiece beyond that afforded by the ⅛ step, parallels of differing thickness can be provided with apertures to receive such pins passing through the parallels and into the apertures of the rows 12 in bearing the weight of the workpiece.

Figure 4:
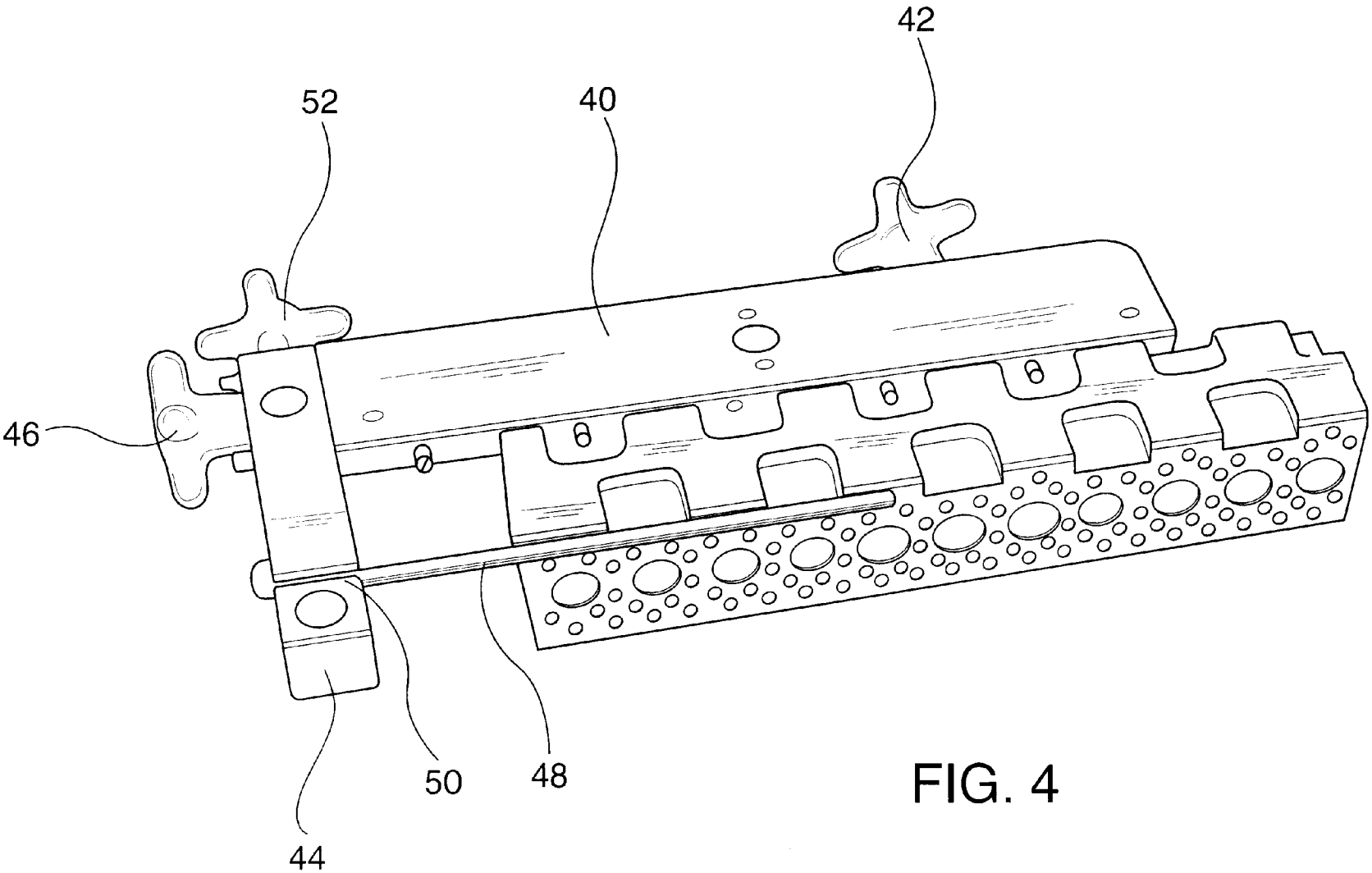

One such combination is shown in FIG. 4 wherein a top plate 40 is secured to the rear of the reversible jaw 10 by means of a first quick release screw 42, a side plate 44 is secured to the top plate 40 by a second quick release screw 46, and a stop rod 48 of predetermined length can be slid back and forth within a slot 50 until tightened by a third quick release screw 52. Using the stop rod 48, a workpiece to be machined can be accurately positioned against the end of the rod 48, and all locked in place by means of the quick release screw 52. In one such usage, a series of stop rods 48 were utilized, of increasing length in ½ inch increments for use as needed for the workpiece in question.

Figure 5:
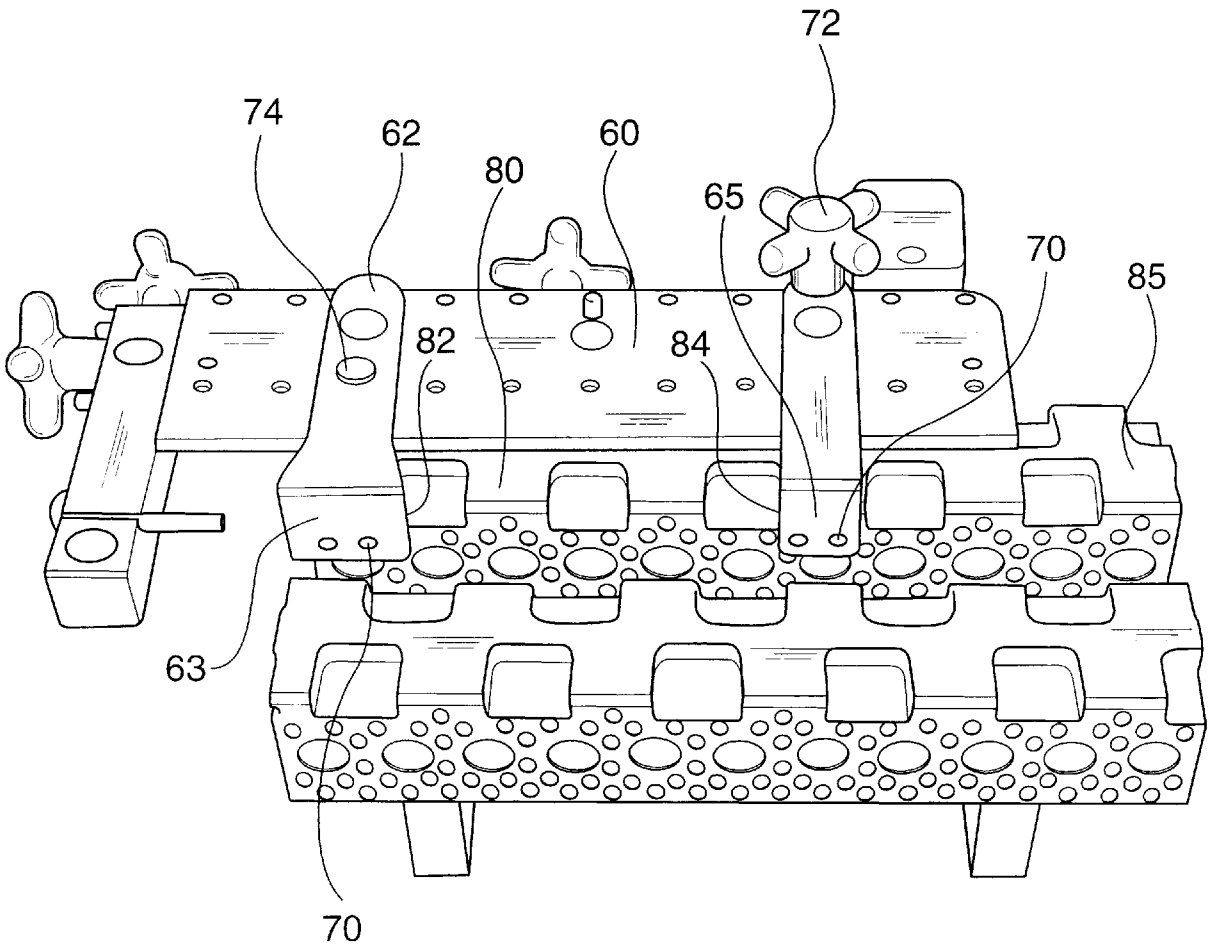

FIG. 5 shows yet another set-up with the removable, reversible jaws of the invention, in which a second top plate 60 is slid over the top plate 40 of FIG. 4 to bear up against the rear cut-outs 34, and receiving a pair of facial top stops 62 of 2 and 1 inch front widths, 63 and 65, respectively. The facial top stops 62 may be first placed in position by pairs of pins as at 70 for coupling with the apertures of the plurality row 12, then being aligned by a quick centering screw 72 before tightening in place by a screw 74 allowing subsequent removal of the centering screw 72. A pair of workpieces 80 supported by the steps of the jaw can then be slid to bear against the edge surfaces 82, 84 for being held in place. In this usage, it will be seen, that the stop rod 48 is not employed, although the side plate 44 need not be removed.

Other accessories can also be secured with the reversible jaws—such a depth stop gauge 85 consisting of a plurality of plates of preset thickness to be rotated in and out of a housing in determining how far down a workpiece may sit, being of a type to screw into the side edge 24 of the reversible jaw. Where the jaw pressure on a part located at one end of the jaw might produce an undesired stress rotation at an opposite end, an adjustable packing of different thickness plates can be inserted at that opposite end to equalize the stress.

As will be understood, because of the symmetry between the two jaws, they, not only can be reversed, but can be interchanged. Because of the further symmetry in the locations of the various apertures and cut-outs, the individual accessories could be reversed from right side to left side, or from left side to right side, so as to be employable both by right-handed machinists, and by left-handed machinists. Single machine parts can be worked on at the left side of the jaws, or at the right side—either between the jaws, or extended therefrom merely by offsetting one jaw compared to the other. To further ease set up, the top plate 60 and the facial top stop 62 could be color coded together, as could the top plate 40 and the side plate 44—but, preferably of a different color code; the result will be seen as allowing the associated pieces in any operation to be employed together. Whether the part to be worked upon is machined manually, or in a computerized machine center—and whether it be one, two, or four parts being worked upon at one set-up—, the machining involved works from a single precise locating hole established by the securement of the jaws and by the additional securement of any top plate or other accessory when so used. Testing has shown that the set up times in these various machining operations can be cut by as much as two-thirds, yet providing very high accuracy.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A reversible jaw for a table vise comprising:

a plurality of horizontally aligned rows of apertures through said law vertically displaced one row from another by predetermined amounts, and with the apertures of each row predeterminedly spaced one aperture from another and from opposing side edges of said jaw;

and a first plurality of cut-outs of predetermined width with predetermined spacing between adjacent cut-outs, measured with respect to said side edges:

with said first plurality of cut-outs extending downwardly a predetermined amount from a too edge of said law and extending rearwardly a predetermined amount from a front edge thereof; and also including a second plurality of cut-outs of predetermined width and predetermined spacing between adjacent cuts, measured with respect to said side edges, with said second plurality of cut-outs extending downwardly a predetermined amount from said top edge of said jaw and extending forwardly a predetermined amount from a rear edge thereof.

2. The reversible jaw of claim 1 wherein the cut-outs of said first and second plurality of cut-outs are of equal width and are equally spaced one from another.

3. The reversible jaw of claim 2 wherein the cut-outs of said first and second plurality of cut-outs extend downwardly equal amounts, and extend rearwardly and forwardly equal amounts as well.

4. The reversible jaw of claim 3 wherein the widths of said cut-outs and the spacing between adjacent cut-outs are equal.

5. The reversible jaw of claim 4 wherein the cut-outs of said first plurality of cut-outs are offset with respect to the cut-outs of said second plurality of cut-outs by ½ the width of said cut-outs.

6. The reversible jaw of claim 3 wherein the depth of a bottom surface of said jaw is greater than the depth of a top surface thereof.

7. The reversible jaw of claim 6 wherein said top surface of said jaw extends to points short of said front and rear edges of said jaw by predetermined amounts.

8. The reversible jaw of claim 1 wherein the apertures of each plurality of rows, except for one such row, are of equal diameters and equally spaced one from another, both horizontally and vertically.

9. The reversible jaw of claim 8 wherein the apertures of said excepted row are of equal diameters, larger than the diameters of the apertures of each other row of said plurality of horizontally aligned rows.

10. The reversible jaw of claim 9 wherein the apertures of said row of larger diameter apertures are equally spaced one from another within said row.

11. The reversible jaw of claim 10 wherein said row of larger diameter apertures extends between front and rear surfaces of said jaw predetermined distances above and below rows of smaller diameter apertures also extending between said front and rear surfaces, respectively.

12. The reversible jaw of claim 11 wherein said jaw additionally includes side and bottom surfaces machined flat.

13. The reversible jaw of claim 12 wherein the apertures of each plurality of rows, except for said one excepted row, are of ¼ inch diameter.

14. The reversible jaw of claim 13 wherein the apertures of said row of larger diameter apertures are equally spaced one from another by 1 inch.

* * * * *